United States Patent [19]

Müller et al.

[11] Patent Number: 5,026,443

[45] Date of Patent: Jun. 25, 1991

[54] STABILIZED EXPLOSIVE AND ITS PRODUCTION PROCESS

[75] Inventors: Dietmar Müller, Karlsruhe; Mathias Helfrich, Landau/Pfalz, both of Fed. Rep. of Germany

[73] Assignee: Fraunhofer-Gesellschaft zur Forderung der angewandten, Munich, Fed. Rep. of Germany

[21] Appl. No.: 572,430

[22] Filed: Aug. 27, 1990

[30] Foreign Application Priority Data

Oct. 14, 1989 [DE] Fed. Rep. of Germany ..... 3934368

[51] Int. Cl.[5] ..... C06B 45/00

[52] U.S. Cl. ..... 149/18; 149/2; 149/21; 149/92; 149/94; 149/96; 149/100; 149/109.6; 264/3.4

[58] Field of Search ..... 149/92, 18, 2, 94, 21, 149/96, 109.6, 100; 264/3.4

[56] References Cited

U.S. PATENT DOCUMENTS

| | | | |
|---|---|---|---|
| 3,745,927 | 7/1973 | Tanner et al. | 149/92 |
| 3,923,564 | 12/1975 | Lantz | 149/92 |
| 4,050,968 | 9/1977 | Goldhagen et al. | 149/92 |
| 4,689,097 | 8/1987 | Jones | 149/92 |

*Primary Examiner*—Stephen J. Lechert, Jr.

*Attorney, Agent, or Firm*—Antonelli, Terry, Stout & Kraus

[57] ABSTRACT

A stabilized high energy explosive, e.g. hexogen (RDX), octogen (HMX) or the like, as a component of NC or plastic-bound propellant charge powders (Lova-TLP) or plastic-bound explosives (PBX) has a particle size up to 5 μm and a stabilizer incorporated into the explosive particles. In order to produce such an explosive, it is proposed that the explosive in the dissolved form and with the stabilizer in the liquid phase is mixed with a proportion of up to approximately 6% and the mixture is brought by flash drying into the solid phase with a particle size of up to 5 μm.

30 Claims, No Drawings

STABILIZED EXPLOSIVE AND ITS PRODUCTION PROCESS

The invention relates to a stabilized or desensitized, high energy explosive, e.g. hexogen i.e., cyclotrimethylene trinitramine (RDX), octogen i.e., cyclotetramethylene tetranitramine (HMX) or the like, as a component of NC or plastic-bound propellant charge powders (Lova-TLP) or plastic-bound explosives (PBX), as well as processes for producing the same.

In the case of propellant charge powders and plastic-bound explosives, it is known to admix as essential components high energy explosives, such as hexogen, octogen or the like. Hexogen and octogen are characterized by a high energy or shattering power which is determinative for their use, but whose processing leads to considerable problems. The high friction and impact sensitivity leads to a correspondingly high safety risk. This risk is increased as the particle size distribution range widens and the coarse particle fraction increases, because e.g. in a propellant charge powder individual particle detonations can occur, which are undesired in use, particularly when used in Lova-TLP. The coarse particle fraction, e.g. in TLP burn-off interruptions leads to hole burning, so that the geometry of the explosive charge varies in an uncontrolled manner and consequently the burn-off behaviour and ballistics are negatively influenced.

In order to reduce the safety risks during processing and also the use disadvantages, it is known to stabilize such high energy explosives (DE-OS No. 37 11 995). For this purpose the explosive is moistened and e.g. coated with wax, accompanied by a simultaneous heating, in a forced mixer. It is also known to coat the granular explosive in a kneader or mixer with a stabilizer in the liquid phase. To this end the actual stabilizer is dissolved with a solvent with respect to which the explosive is either insoluble or only slightly soluble. The granular explosive is mixed into the solution close to its boiling point.

After removing the solvent and any water humidity still present, granulation takes place in the same mixer. This takes place within the scope of a so-called build-up granulation, in that with a particle size distribution between 1 and 100 μm the particle fraction up to 50 μm is separately granulated and agglomerated and coated with a common stabilizer coating, whereas the coarser particles are individually coated with the stabilizer. In the case of hexogen (RDX), a wax is proposed as the stabilizer and is dissolved in perchloroethylene. In addition, graphite powder is added, which also has a stabilizing action and in particular prevents electrostatic charges.

A high energy explosive produced in this way has a wide particle size distribution with a high proportion of coarse particles, so that the aforementioned disadvantages occur during processing and use. Explosives prepared in the said known manner cannot be added with the otherwise very advantageous processing of propellant charge powders and explosive mixtures in extruders, particularly twin screw extruders, because the safety risk is too great.

The problem of the invention is to propose explosives of the aforementioned type, which can be processed with a much reduced safety risk and in particular also in an extruder and which also lead to a better burn-off behaviour, especially following a burn-off interruption.

The invention also aims at a process for producing such explosives.

According to the invention this problem is solved in that the explosive has a particle size up to 5 μm and that the stabilizer is incorporated into the explosive particles.

Practical tests have shown that an explosive built up in this way can be used without difficulty as a component in the formulation of explosive mixtures or Lova-TLP in extruder processes, without damage and hazards occurring during extrusion. PBX and Lova-TLP with such a high energy explosive with a restricted particle size range have a lower friction and impact sensitivity and a much more uniform burn-off behaviour.

Preferably the explosive has a particle size between 3 and 5 μm. The stabilizer can be present in a proportion of up to 6% and preferably between 0.3 and 2%.

In a further preferred construction the stabilizer is at the same time one of the components of the TLP or PBX formulation, e.g. a plasticizer for the plastic binder contained therein. As a result of this measure the formulation or its characteristics are not unfavourably influenced by the stabilizer, in that the stabilizer proportion can be incorporated into the total proportion of said addition to the formulation.

The stabilizer can e.g. be dibutyl phthalate (DBP), but is preferably di-(2-ethyl hexyl)-adipate (DOA).

For the production of the aforementioned explosive, the invention uses as a basis the known process (DE-OS NO. 37 11 995), in that the explosive particles (RDX or HMX) are stabilized with a stabilizer in the liquid phase. The stabilized explosive can then be mixed with the other components to the Lova-TLP or PBX formulation. For solving the problem of the invention, it is proposed that the explosive in the dissolved state and with the stabilizer in the liquid phase is mixed with a proportion of up to approximately 6% and the mixture is brought by spray or flash drying into the solid phase with a particle size up to 5 μm.

Practical tests have shown that the transformation of the explosive and the stabilizer into the liquid phase and subsequent spray drying on the one hand leads to a relatively narrow particle size distribution with a small particle size and on the other makes it possible to obtain a completely satisfactory stabilization of the individual particles the stabilizing component is not only formed externally on the particles, but is also incorporated into the particle cavities and is particularly effective there. The reduction of the particle size distribution can easily be brought about by a corresponding temperature control and quantity regulation, as well as through the use of suitable geometries for the spraying nozzle. The throughput, product and transport gas temperatures, as well as the nozzle geometry are to be correspondingly matched to one another, which can easily be brought about by simple tests. Apart from the attainable positive product characteristics, this process has the major advantage that it permits a continuous production of the stabilized explosive. In conjunction with a subsequent extrusion in a twin screw extruder, which is only possible in a safe manner as a result of the present invention, the continuous production can be followed by a continuous processing.

Preferably the explosive is dissolved with dimethyl formamide (DMF) or dimethyl sulphoxide (DMSO) whilst, as stated, a component of the Lova-TLP or PBX formulation, e.g. a plasticizer for its plastic binder is added as the stabilizer.

In the case of the inventive process there is no additional moistening of the explosive with water and the subsequently necessary expulsion of the water. The solvents for the explosive and for the stabilizer can easily be recovered during flash drying, so that there is no disadvantage for the environment.

Reference has already been made to the preferred stabilizers, their proportion and the preferred particle size range. Flash drying in the case of the indicated solvents advantageously takes place at a product temperature above 100° C., but below the decomposition temperature of the explosives. The temperature for the transport air used in flash drying can be higher, e.g. about 150° C.

The particle size and particle size distribution can be particularly easily controlled if the mixture is sprayed by means of a two or multiple substance nozzle, together with compressed air, compressed gas or a fluid inert with respect to the mixture.

The following tests were performed:

TEST 1

Hexogen (RDX) was dissolved in dimethyl formamide (DMF) and mixed with 5% dibutyl phthalate (DBP) and the mixture was sprayed at a temperature of around 110° C.

TEST 2

Hexogen (RDX) was again dissolved with dimethyl formamide (DMF) and sprayed with 5% di-(2-ethyl hexyl)-adipate (DOA) at 110° C.

TEST 3

Once again hexogen (RDX) was dissolved in dimethyl formamide (DMF), but no stabilizer was added and the explosive solution was sprayed under the same conditions.

In all the aforementioned cases it was possible to obtain a product with a particle size range of 3 to 5 μm.

Hereinafter are given the safety data measured with the aforementioned test products and a standard hexogen product.

| Friction sensitivity | Particle size | Reaction at |
|---|---|---|
| Product 1 (with DBP) | 3–5 μm | 14.4 kg |
| Product 2 (with DOA) | 3–5 μm | 20.0 kg |
| Product 3 (without additive) | 3–5 μm | 12.0 kg |
| Ground hexogen (without additive) | 10 μm | 13.0 kg |

| Impact sensitivity | Reaction at |
|---|---|
| Product 1 | <0.2 kgm |
| Product 2 | <0.2 kgm |
| Product 3 | <0.2 kgm |
| Ground hexogen (10 μm) | 0.20 kgm |
| Ground hexogen (above 300 μm) | 0.30 kgm |

The friction and impact sensitivity were measured according to the BAM method (Bundesantalt für Materialprüfung) (R. Meyer "Explosivstoffe", 6th edition, pp 247/8 and 254/5, VCH Verlagsgesellschaft mbH, D-6940 Weinheim, ISBN No. 3-527-26297-0 and R. Meyer "Explosives", 3rd edition, VCH Publishers, New York/N.Y. 10010-406, USA, IBSN No. 0-89573-600-4).

The tests show that with regards to the friction and impact sensitivity the least favourable results occur with hexogen which has merely been ground and not stabilized.

We claim:

1. A stabilized, high energy explosive, comprising explosive particles having a particle size up to 5 μm and a stabilizer incorporated into the explosive particles.

2. Explosive according to claim 1, wherein the explosive particles have a particle size between 3 and 5 μm.

3. Explosive according to claim 1, wherein the stabilizer is present in a proportion of up to 6%.

4. Explosive according to claim 1, wherein the stabilizer is present in a proportion of 0.3 to 2%.

5. Explosive according to claim 1, wherein the stabilizer is at the same time one of the components of the propellant charge powder formulation.

6. Explosive according to claim 5, wherein is at the same time a plasticizer for the propellant charge powder.

7. Explosive according to claim 1, wherein the stabilizer is dibutyl phthalate.

8. Explosive according to claim 1, wherein the stabilizer is di-(2-ethyl hexyl)-adipate.

9. Process for the production of high energy explosives with a small particle size, comprising dissolving the explosive and mixing the dissolved explosive with a stabilizer in the liquid phase with a proportion of up to approximately 6% and bringing the mixture by flash drying into the solid phase with a particle size of up to 5 μm.

10. Process according to claim 9, wherein the explosive is dissolved with dimethyl formamide or dimethyl sulphoxide.

11. Process according to claim 9, wherein a component of the propellant charge powder formulation is used as the stabilizer.

12. Process according to claim 11, wherein a plasticizer for the propellant charge powder is used as the stabilizer.

13. Process according to claim 9, wherein dibutyl phthalate or di-(2-ethyl hexyl)-adipate is used as the stabilizer.

14. Process according to claim 9, wherein the liquid stabilizer is added in a proportion between 0.3 and 2%.

15. Process according to claim 9, wherein flash drying takes place at a product temperature above 100° C. and below the decomposition temperature of the explosive.

16. Process according to cliam 15, wherein the transport air used in flash drying has a higher temperature than the product temperature.

17. Process according to claim 16, wherein the transport air has a temperature of approximately 150°C.

18. Process according to claim 15, wherein the mixture is sprayed by means of a two or multiple substance nozzle together with compressed air, compressed gas or a fluid inert with respect to the mixture.

19. Explosive according to claim 1, wherein said explosive particles are a component of nitrocellulose or plastic-bound propellant charge powder.

20. Explosive according to claim 1, wherein said explosive particles are a component of a plastic bound explosive.

21. Explosive according to claim 20, wherein the stabilizer is at the same time one of the components of the plastic bound explosive formulation.

22. Explosive according to claim 21, wherein the stabilizer is at the same time a plasticizer for plastic binder of said plastic bound explosive.

23. Explosive according to claim 1, wherein said explosive particles are particles of cyclotrimethylene trinitramine.

24. Explosive according to claim 1, wherein said explosive particles are particles of cyclotetramethylene tetranitramine.

25. Process according to claim 9, further comprising mixing said high energy explosive having a particle size of up to 5 μm with further components to form a nitrocellulose or plastic bound propellant charge powder.

26. Process according to claim 9, further comprising mixing said high energy explosives having a particles size of up to 5 μm with other components comprising a plastic binder to form a plastic bound explosive.

27. Process according to claim 26, wherein a component of the plastic bound explosive is used as the stabilizer.

28. Process according to claim 27, wherein a plasticizer for the plastic binder is used as the stabilizer.

29. Process according to claim 9, wherein said explosive is cyclotrimethylene trinitramine.

30. Process according to claim 9, wherein said explosive is cyclotetramethylene tetranitramine.

* * * * *

UNITED STATES PATENT AND TRADEMARK OFFICE

CERTIFICATE OF CORRECTION

PATENT NO. : 5,026,443

DATED : June 25, 1991

INVENTOR(S) : MULLER, et al

It is certified that error appears in the above-identified patent and that said Letters Patent is hereby corrected as shown below:

On the Title page, item (73), the assignee shoule read

--Fraunhofer-Gesellschaft zur Forderung der angewandten Forschung e.V. --

Signed and Sealed this

Fifteenth Day of December, 1992

*Attest:*

DOUGLAS B. COMER

*Attesting Officer*

*Acting Commissioner of Patents and Trademarks*